US008316542B2

(12) United States Patent
Imai et al.

(10) Patent No.: US 8,316,542 B2
(45) Date of Patent: Nov. 27, 2012

(54) METHOD OF MANUFACTURING TOTAL HEAT EXCHANGE ELEMENT AND TOTAL HEAT EXCHANGE ELEMENT

(75) Inventors: Takanori Imai, Tokyo (JP); Hidemoto Arai, Tokyo (JP); Masaru Takada, Tokyo (JP); Yoichi Sugiyama, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 509 days.

(21) Appl. No.: 12/595,031

(22) PCT Filed: Apr. 17, 2007

(86) PCT No.: PCT/JP2007/058369

§ 371 (c)(1),
(2), (4) Date: Oct. 7, 2009

(87) PCT Pub. No.: WO2008/129669

PCT Pub. Date: Oct. 30, 2008

(65) Prior Publication Data

US 2011/0146961 A1 Jun. 23, 2011

(51) Int. Cl.
*B21D 53/02* (2006.01)
*F28F 3/00* (2006.01)

(52) U.S. Cl. ..... 29/890.03; 29/527.2; 165/133; 165/166

(58) Field of Classification Search ..... 29/469.5, 29/890.039, 890.054; 165/133, 164, 166, 165/170

See application file for complete search history.

(56) References Cited

U.S. PATENT DOCUMENTS

| | | | | |
|---|---|---|---|---|
| 5,832,993 | A * | 11/1998 | Ohata et al. | 165/166 |
| 6,019,170 | A * | 2/2000 | Yokoya et al. | 165/166 |
| 6,032,730 | A * | 3/2000 | Akita et al. | 165/166 |
| 6,536,514 | B1 | 3/2003 | Sugiyama et al. | |
| 7,320,361 | B2 | 1/2008 | Arai et al. | |
| 2003/0094269 | A1 | 5/2003 | Arai et al. | |
| 2005/0082045 | A1 * | 4/2005 | Takada et al. | 165/133 |

FOREIGN PATENT DOCUMENTS

| | | | |
|---|---|---|---|
| CN | 1420337 | | 5/2003 |
| GB | 2407151 | A * | 4/2005 |
| JP | 55-094621 | A | 7/1980 |
| JP | 58-132545 | A | 8/1983 |
| JP | 62-026498 | A | 2/1987 |

(Continued)

OTHER PUBLICATIONS

International Search Report (PCT/ISA/210) for PCT/JP2007/058369 mailed Jul. 31, 2007.

(Continued)

*Primary Examiner* — Alexander P Taousakis
(74) *Attorney, Agent, or Firm* — Buchanan Ingersoll & Rooney PC

(57) ABSTRACT

A total heat exchange element includes a sheet-like partitioning member and space holding members on both sides of the partitioning member to form air paths and performs a heat exchange via the partitioning member between an air flow flowing through an air path formed on one side of the partitioning member and an air flow flowing through an air path formed on other side of the partitioning member. The partitioning member and the space holding members are bonded by a water-solvent adhesive in which a water-soluble moisture-absorbing agent is dissolved.

15 Claims, 3 Drawing Sheets

FOREIGN PATENT DOCUMENTS

| | | | |
|---|---|---|---|
| JP | 05-087477 | A | 4/1993 |
| JP | 05-309771 | A | 11/1993 |
| JP | 08-254400 | A | 10/1996 |
| JP | 2829356 | B2 | 9/1998 |
| JP | 2001-027489 | A | 1/2001 |
| JP | 2002-310589 | A | 10/2002 |
| JP | 2003-148892 | A | 5/2003 |
| JP | 2004-225969 | A | 8/2004 |
| JP | 2005-024207 | A | 1/2005 |

OTHER PUBLICATIONS

Written Opinion (PCT/ISA/237) for PCT/JP2007/058369 mailed Jul. 31, 2007.

Office Action dated Nov. 8, 2010, issued in the corresponding Chinese Patent Application No. 200780052624.6.

* cited by examiner

METHOD OF MANUFACTURING TOTAL HEAT EXCHANGE ELEMENT AND TOTAL HEAT EXCHANGE ELEMENT

TECHNICAL FIELD

The present invention relates to a method of manufacturing a heat exchange element used in air conditioning apparatuses and the like and the heat exchange element, and more particularly, to a method of manufacturing a total heat exchange element that performs heat exchange of both latent heat and sensible heat between two kinds of air flows having different temperature and humidity states and the total heat exchange element.

BACKGROUND ART

As one of heat exchange elements used in air conditioning apparatuses and the like, there is a cross-flow total heat exchange element having laminated structure. In this total heat exchange element, a plurality of element forming units are laminated in predetermined directions, respectively. The respective element forming units have sheet-like partitioning members and space holding members of, for example, a corrugated shape that are bonded to the partitioning members and form paths for air flows in conjunction with the partitioning members. Corrugations of the space holding member in one element forming unit and corrugations of the space holding member in the element forming unit above or below the one element forming unit cross each other at 90 degrees or an angle close to 90 degrees in plan view. When two kinds of air flows having states different from each other, in general, two kinds of air having temperature and humidity states different from each other are fed to the path in the one element forming unit and the path in the element forming unit above or below the one element forming unit, exchange of latent heat and sensible heat is performed between these two kinds of air flows via the partitioning members.

In terms of improving heat exchange efficiency in the total heat exchange element, it is desirable to increase heat transferability and moisture permeability of the partitioning members. Therefore, the partitioning members are formed by a material having high moisture absorption or moisture permeability. For example, Patent Document 1 discloses a total heat exchanger material made of a material obtained by depositing a moisture-absorbing agent on the surface of a metal sheet or a plastic sheet. Patent Document 2 discloses a heat exchange element in which a moisture-absorbing agent is impregnated in a porous member formed by non-woven fabric, metal fiber, glass fiber, or the like to form a base material and partitioning members and space holding members are formed by a material obtained by forming a moisture permeable film on the surface of this base material.

Patent Document 3 discloses a heat exchanger in which partitioning members and space holding members are formed by a material obtained by forming a moisture-absorbing diffusion layer with fluorine or hydrocarbon resin on the surface of the porous member. Patent Document 4 discloses a total heat exchanger element in which partitioning members or space holding members are formed by a material obtained by depositing an absorptive moisture-absorbing agent on the surface of a sheet made of metal, plastic, or paper. Patent Document 5 discloses a heat exchanger in which partitioning members and space holding members are formed by a material having different contraction and expansion properties with respect to moisture on one surface and the other surface.

In these days, to realize reduction in material cost and improvement of productivity, a total heat exchange element is also developed in which partitioning members and space holding members are formed by paper having a water-soluble or non-water-soluble moisture-absorbing agent impregnated therein or deposited thereon. As the water-soluble moisture-absorbing agent, for example, alkali metallic salt such as lithium chloride or alkali metallic salt such as calcium chloride is used. As the non-water-soluble-agent, a granular solid such as silica gel, strong acid ion exchange resin, or strong basic ion exchange resin is used. A flame retardant or the like can be further added to the partitioning members and the space holding members according to necessity.

In the total heat exchanging element in which the partitioning members and the space holding members are formed by paper, element forming units are formed by bonding the partitioning members and the space holding members to each other with an adhesive. The total heat exchange element is manufactured by laminating a necessary number of the element forming units in a predetermined direction. In manufacturing the total heat exchange element, the element forming units adjacent to each other in the laminating direction are bonded to each other by an adhesive. It is possible to use both water-solvent and organic solvent adhesives for the bonding of the partitioning members and the space holding members and the bonding of the element forming units.

However, when the organic solvent adhesive is used, vaporization of an organic solvent, dissipation of odor, and the like occur from the total heat exchange element. When the organic solvent adhesive is used, complicated and expensive accessories such as an apparatus for collecting the organic solvent has to be provided in a production facility for the total heat exchange element. Because of these reasons, the water-solvent adhesive is often used in, in particular, a total heat exchange element for air conditioning apparatuses.

When the water-solvent adhesive is used, if a moisture-absorbing agent is water soluble, the moisture-absorbing agent diffuses to both the partitioning member made of paper and the space holding member made of paper via the water-solvent adhesive. Therefore, in this case, even when the water-soluble moisture-absorbing agent is impregnated in one of the partitioning members and the space holding members in advance and, thereafter, the partitioning members and the space holding members are bonded to manufacture element forming units, it is possible to obtain element forming units in which the moisture-absorbing agent is impregnated in both the partitioning members and the space holding members.

Patent document 1: Japanese Patent Application Laid-open No. S58-132545

Patent Document 2: Japanese Patent Application Laid-open No. 2002-310589

Patent Document 3: Japanese Patent Application Laid-open No. 2005-24207

Patent Document 4: Japanese Patent No. 2829356

Patent Document 5: U.S. Pat. No. 6,536,514

DISCLOSURE OF INVENTION

Problem to be Solved by the Invention

However, if it is attempted to impregnate a large amount of water-soluble moisture-absorbing agent in the partitioning members made of paper in advance and bond the partitioning members and the space holding members to each other to manufacture the element forming units, productivity falls. Specifically, the partitioning members impregnated with the water-soluble moisture-absorbing agent in advance are usually manufactured by shaping long base paper impregnated with the water-soluble moisture-absorbing agent into a roll, drawing out the base paper from this roll, and cutting the base paper in predetermined size. When an impregnation amount of the water-soluble moisture-absorbing agent increases, an amount of the moisture absorption by the moisture-absorbing agent also increases and the base paper adheres in the roll. As a result, the base paper cannot be drawn out from the roller, i.e., blocking tends to occur. When this blocking occurs, because a manufacturing process for the partitioning members is suspended or the manufacturing of the partitioning members is disabled, productivity falls. The same holds true when a large amount of water-soluble moisture-absorbing agent is impregnated in the space holding members made of paper in advance or when a large amount of another water-soluble agent is impregnated in the partitioning members made of paper or the space holding members made of paper in advance.

When the water-soluble moisture-absorbing agent is impregnated in paper, the strength of the paper is degraded. When it is attempted to shape the paper into corrugated space holding members, a deficiency such as occurrence of a break tends to occur. Further, deformation involved in moisture absorption is conspicuous in the element forming units. When a large amount of moisture-absorbing agent is impregnated in the partitioning members and the space holding members in advance, the element forming units are deformed by moisture absorption until the element forming units are assembled in the total heat exchange element. Workability in assembling the element forming units in the total heat exchange element tends to fall. The same holds true when a large amount of another water-soluble agent is impregnated in the partitioning members or the space holding members made of paper in advance.

The present invention has been devised in view of the circumstances and it is an object of the present invention to obtain a method of manufacturing a total heat exchange element that makes it easy to manufacture, under high productivity, a total heat exchange element made of paper impregnated with a desired amount of an agent. It is another object of the present invention to obtain a total heat exchange element made of paper impregnated with a desired amount of an agent that is easily manufactured under high productivity.

Means for Solving Problem

To achieve the above object, in a method of manufacturing a total heat exchange element according to the present invention space holding members are provided on both sides of a sheet-like partitioning member to form air paths. The total heat exchange element performs a heat exchange via the partitioning member between an air flow flowing through an air path formed on one side of the partitioning member and an air flow flowing through an air path formed on other side of the partitioning member. The method includes bonding the partitioning member and the space holding members by a water-solvent adhesive in which a water-soluble moisture-absorbing agent is dissolved.

In a method of manufacturing a total heat exchange element according to another aspect of the present invention, plural element forming units each including a sheet-like partitioning member and space holding members bonded to the partitioning member to form air paths for air flows are laminated. The total heat exchange element performs a heat exchange via the partitioning member between air flows flowing through the air paths adjacent to each other in a laminating direction. The method includes a bonding step of obtaining an element forming unit in which the partitioning member and the space holding members are bonded by an adhesive and a laminating step of bonding element forming units with the adhesive to obtain a total heat exchange element in which plural element forming units are laminated. At least one of the bonding step and the laminating step includes employing a water-solvent adhesive in which a water-soluble moisture-absorbing agent is dissolved.

In a method of manufacturing a total heat exchange element according to still another aspect of the present invention, space holding members are provided on both sides of a sheet-like partitioning member to form air paths. The total heat exchange element performs a heat exchange via the partitioning member between an air flow flowing through an air path formed on one side of the partitioning member and an air flow flowing through an air path formed on other side of the partitioning member. Each of the partitioning member and the space holding members is made of paper. The method includes bonding the partitioning member and the space holding members by a water-solvent adhesive in which a water-soluble flame retardant is dissolved.

In a method of manufacturing a total heat exchange element according to still another aspect of the present invention, plural element forming units each including a sheet-like partitioning member and space holding members bonded to the partitioning member to form air paths for air flows are laminated. The total heat exchange element performs a heat exchange via the partitioning member between air flows flowing through the air paths adjacent to each other in a laminating direction. The method includes a bonding step of obtaining an element forming unit in which the partitioning member and the space holding members are bonded by an adhesive and a laminating step of bonding element forming units with the adhesive to obtain a total heat exchange element in which plural element forming units are laminated. Each of the partitioning member and the space holding members is made of paper. At least one of the bonding step and the laminating step includes employing a water-solvent adhesive in which a water-soluble flame retardant is dissolved.

In a method of manufacturing a total heat exchange element according to still another aspect of the present invention, space holding members are provided on both sides of a sheet-like partitioning member to form air paths. The total heat exchange element performs a heat exchange via the partitioning member between an air flow flowing through an air path formed on one side of the partitioning member and an air flow flowing through an air path formed on other side of the partitioning member. The method includes bonding the partitioning member and the space holding members by a water-solvent adhesive in which a water-soluble moisture-absorbing agent and a water-soluble flame retardant are dissolved.

In a method of manufacturing a total heat exchange element according to still another aspect of the present invention, plural element forming units each including a sheet-like partitioning member and space holding members bonded to the partitioning member to form air paths for air flows are laminated. The total heat exchange element performs a heat exchange via the partitioning member between air flows flowing through the air paths adjacent to each other in a laminating direction. The method includes a bonding step of obtaining an element forming unit in which the partitioning member and the space holding members are bonded by an adhesive and a laminating step of bonding element forming units with the adhesive to obtain a total heat exchange element in which plural element forming units are laminated. At least one of the bonding step and the laminating step includes employing a water-solvent adhesive in which a water-soluble moisture-absorbing agent and a water-soluble flame retardant are dissolved.

A total heat exchange element according to still another aspect of the present invention includes a sheet-like partitioning member and space holding members provided on both sides of the partitioning member to form air paths in conjunction with the partitioning member, and performs a heat exchange via the partitioning member between an air flow flowing through an air path formed on one side of the partitioning member and an air flow flowing through an air path formed on other side of the partitioning member. The partitioning member and the space holding members are bonded to each other by either one of a water-solvent adhesive containing a water-soluble moisture-absorbing agent and a water-solvent adhesive containing a water-soluble moisture-absorbing agent and a water-soluble flame retardant.

A total heat exchange element according to still another aspect of the present invention includes a sheet-like partitioning member and space holding members provided on both sides of the partitioning member to form air paths in conjunction with the partitioning member, and performs a heat exchange via the partitioning member between an air flow flowing through an air path formed on one side of the partitioning member and an air flow flowing through an air path formed on other side of the partitioning member. Each of the partitioning member and the space holding members is made of paper. The partitioning member and the space holding members are bonded to each other by a water-solvent adhesive containing a water-soluble flame retardant.

Effect of the Invention

In the method of manufacturing a total heat exchange element according to the present invention, because the element forming units and the total heat exchange element are obtained by using the water-solvent adhesive in which the water-soluble moisture-absorbing agent or the flame retardant is dissolved, it is unnecessary to impregnate a large amount of water-soluble moisture-absorbing agent or the flame retardant in the partitioning members and the space holding members before bonding in advance. Therefore, it is possible to obtain, without deteriorating the strength of base papers as materials of the partitioning members and the space holding members, the partitioning members and the space holding members from the base papers. As a result, it is possible to obtain the partitioning members and the space holding members under satisfactory workability. The occurrence of blocking is suppressed even when long base paper as a material of the partitioning members and long base paper as a material of the space holding members are shaped into rolls, respectively, and the partitioning members and the space holding members are sequentially manufactured while the base papers are drawn out from these rolls or when a long laminated member as a material of the element forming units is manufactured.

Furthermore, because it is possible to easily prevent, from the time when a plurality of element forming units are obtained until these element forming units are assembled in the total heat exchange element, the element forming units from being conspicuously deformed by moisture absorption, it is possible to easily suppress the fall in workability in assembling the total heat exchange element. Therefore, according to the present invention, it is easy to manufacture, under high productivity, the total heat exchange element made of paper impregnated with a desired amount of an agent.

EXPLANATIONS OF LETTERS OR NUMERALS

1 partitioning member
5 space holding member
7A, 7B, 36, 62 adhesives
10, 10*a* to 10*f* element forming units
12 heat exchange unit
20 total heat exchange element

BEST MODE(S) FOR CARRYING OUT THE INVENTION

Exemplary embodiments of a method of manufacturing a total heat exchange element according to the present invention are explained in detail below with reference to the accompanying drawings. The present invention is not limited to the embodiments explained below.

First Embodiment

Figure 1:
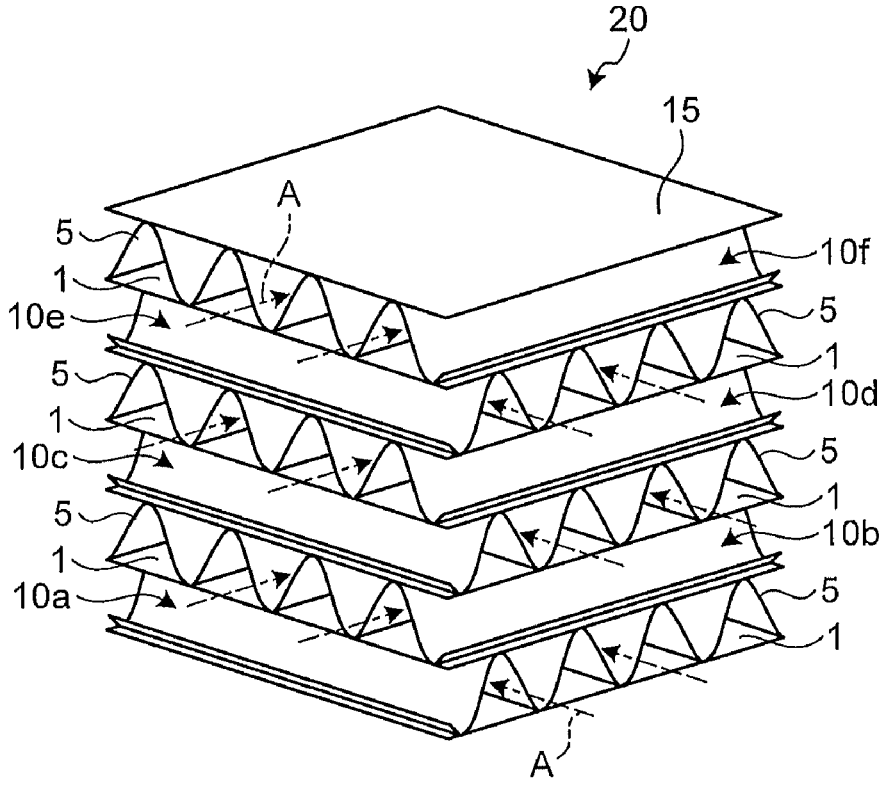
FIG. 1 is a schematic perspective view of an example of a total heat exchange element.

FIG. 1 is a schematic perspective view of an example of a total heat exchange element. The total heat exchange element shown in the figure is a cross-flow total heat exchange element in which plural element forming units are laminated. In FIG. 1, six element forming units 10*a* to 10*f* are shown.

The respective element forming units 10*a* to 10*f* have sheet-like partitioning members 1 and corrugated space holding members 5 that are respectively bonded on the partitioning members 1 and form paths for air flows. The partitioning members 1 and the space holding members 5 are mad of paper. A desired water-soluble agent is impregnated in the partitioning members 1 and the space holding members 5. The partitioning members 1 and the space holding members 5 in the element forming units 10*a* to 10*f* are bonded to each other by a water-solvent adhesive (not shown). The element forming units adjacent to each other in a laminating direction are also bonded to each other by the water-solvent adhesive (no shown).

Corrugations of the space holding member 5 in one element forming unit forming a total heat exchange element 20 and corrugations of the space holding member 5 in the element forming unit above or below the one element forming unit cross each other at 90 degrees or an angle near 90 degrees in plan view. In other words, a longitudinal direction of respective recesses and projections in the space holding member 5 in the one element forming unit and a longitudinal direction of respective recesses and projections in the space holding member 5 in the element forming unit above or below the one element forming unit cross each other at 90 degrees or an angle close to 90 degrees in plan view. A top plate member 15 formed by the same material as the partitioning member 1 is bonded on the uppermost element forming unit 10*f* by a water-solvent adhesive.

In the total heat exchange element 20 having the configuration explained above, spaces between the partitioning members 1 and the space holding members 5 in the respective element forming units 10*a* to 10*f*, spaces between the space holding members 5 in the element forming units 10*a* to 10*e* and the partitioning members 1 in the element forming units 10*b* to 10*f* above the element forming units 10*a* to 10*e*, and spaces between the space holding member 5 and the top plate member 15 in the element forming unit 10*f* are paths for air flows, respectively, as indicated by allows A of an alternate long and two short dashes line in FIG. 1.

Figure 2:
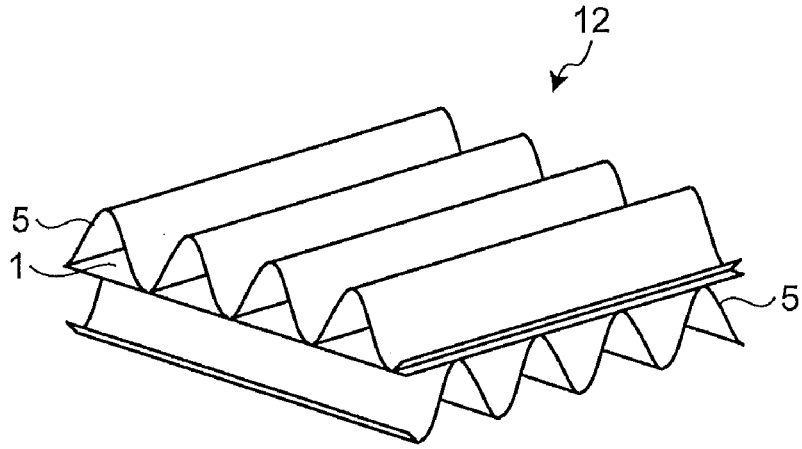
FIG. 2 is a schematic perspective view of a heat exchange unit in the total heat exchange element shown in FIG. 1.

As a result, heat exchange is performed via the partitioning members 1 between the air flows flowing through the paths adjacent to each other in the laminating direction of the element forming units 10*a* to 10*f*. Heat exchange of latent heat and sensible heat is performed via the partitioning members 1 between the air flow flowing through the path in one element confirming unit and the air flow flowing through the path in the other element forming unit adjacent to each other in the laminating direction. As shown in FIG. 2, in the total heat exchange element 20, one heat exchange unit 12 is formed by one partitioning member 1 and two space holding members 5 and 5 provided on both sides of the partitioning member 1 and bonded by the adhesive explained above.

In manufacturing the total heat exchange element 20 having the configuration explained above, a bonding step of obtaining the element forming units 10*a* to 10*f* in which the partitioning members 1 and the space holding members 5 are bonded to each other by the adhesive and a laminating process for bonding the element forming units 10*a* to 10*f* with the adhesive to obtain the total heat exchange element 20 in which a plurality of element forming units are laminated are performed. In the manufacturing method according to this embodiment, in manufacturing the total heat exchange element 20, a water-solvent adhesive in which a water-soluble moisture-absorbing agent is dissolved is used in both the bonding step and the laminating step.

Figure 3:
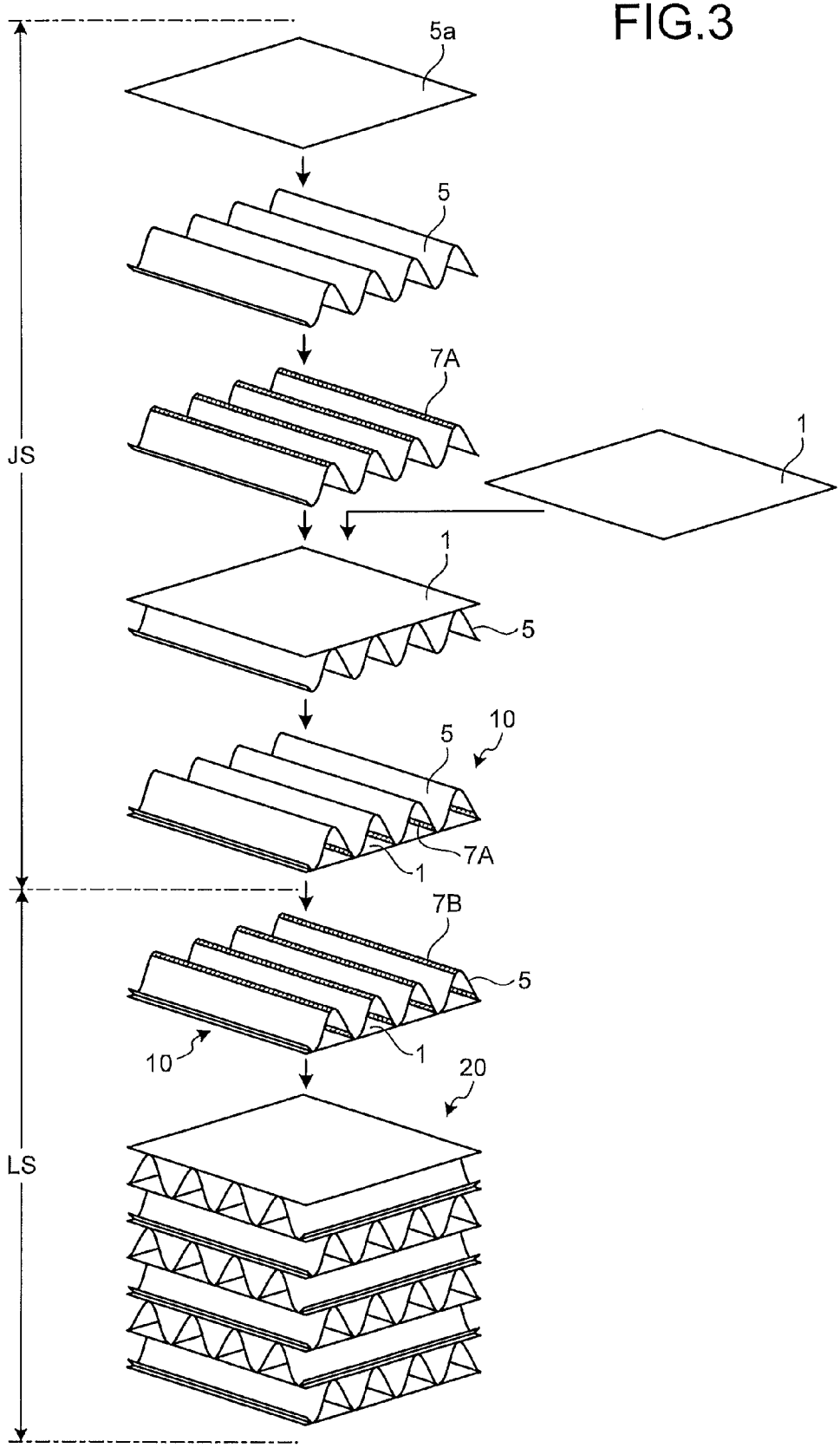
FIG. 3 is a flowchart for schematically explaining an example of a manufacturing process in manufacturing the total heat exchange element shown in FIG. 1.

FIG. 3 is a flowchart for schematically explaining an example of a manufacturing process in manufacturing the total heat exchange element 20. The example shown in the figure is a manufacturing process in obtaining, after manufacturing a necessary number of element forming units according to batch processing, laminating the element forming units to obtain a total heat exchange element. The bonding step JS explained above and the laminating step LS explained above are performed in this order.

In the bonding step JS shown in the figure, first, base paper 5*a* is shaped in a corrugated shape to obtain the space holding member 5. An adhesive in which a water-soluble moisture-absorbing agent is dissolved, for example, a water-solvent adhesive 7A in which, for example, alkali metal salt such as lithium chloride or alkali metal salt such as calcium chloride is dissolved is applied to apexes of the corrugated shape on one side in the space holding member 5. Subsequently, the partitioning member 1 separately manufactured is arranged on the space holding member 5 and the partitioning member 1 and the space holding member 5 are bonded by the adhesive 7A to obtain an element forming unit 10. The element forming unit 10 is any one of the element forming units 10*a* to 10*f* shown in FIG. 1. A necessary number of element forming units are manufactured by the same procedure as the manufacturing procedure for the element forming unit 10.

A moisture-absorbing agent is not impregnated in or added to the base paper 5*a*. A moisture-absorbing agent is not impregnated in or added to the partitioning member 1, which is not yet bonded to the space holding member 5. As the water-solvent adhesive as a material of the adhesive 7A, for example, a polyvinyl acetate emulsion adhesive can be used.

At the laminating step LS, first, a water-soluble moisture-absorbing agent, for example, a water-solvent adhesive 7B in which alkali metal salt such as lithium chloride or alkali metal salt such as calcium chloride is dissolved is sequentially applied to apexes of the corrugated shape of the space holding members 5 in the element forming unit 10 manufactured at the bonding step JS and other element forming units (not shown). While directions of the element forming units are selected such that corrugations of the space holding member 5 in one element forming unit and corrugations of the space holding member 5 in the element holding unit above or below the one element forming unit cross each other at 90 degrees or an angle close to 90 degrees in plan view, the element forming units applied with the adhesive 7B are sequentially laminated and the element forming units adjacent to each other in the laminating direction are bonded to each other by the adhesive 7B. Thereafter, the top plate member 15 (see FIG. 1) is bonded on the space holding member 5 in the element forming unit, to only one side of which the partitioning member 1 is bonded, by the adhesive 7B. The total heat exchange element 20 shown in FIG. 1 is obtained by bonding the members up to the top plate member 15.

When the total heat exchange element 20 is manufactured in this way, the water-soluble moisture-absorbing agent dissolved in the adhesives 7A and 7B applied to the space holding members 5 diffuses to the total heat exchange element 20. An impregnation amount of the moisture-absorbing agent in the total heat exchange element 20 is a sum of content of the moisture-absorbing agent in the applied adhesive 7A and content of the moisture-absorbing agent in the applied adhesive 7B. Therefore, content of the moisture-absorbing agent in the total heat exchange element 20 can be controlled by appropriately selecting the concentration of the water-soluble moisture-absorbing agent in the adhesives 7A and 7B and an application amount of the adhesives 7A and 7B. The concentration of the moisture-absorbing agent in the adhesives 7A and 7B can be arbitrarily adjusted in a range equal to or lower than saturation concentration of the moisture-absorbing agent.

For example, if 20 percent by mass of water and 15 percent by mass of lithium chloride, which is a water-soluble moisture-absorbing agent, are mixed in a polyvinyl acetate emulsion adhesive with 40 percent of mass of solid content, a water-solvent adhesive with 30 percent by mass of resin solid content, 59 percent by mass of water, and 11 percent by mass of lithium chloride can be obtained. If this adhesive is used as the adhesive 7A shown in FIG. 2 and an application amount of the adhesive is set to 15 grams in terms of weight per unit area (1 $m^2$) of the partitioning member 1 and if the adhesive is also used as the adhesive 7B shown in FIG. 2 and an application amount of the adhesive is set to 40 grams in terms of weight per unit area (1 $m^2$) of the partitioning member 1, the lithium chloride of about 6 grams ((15+40)×11%) in terms of weight per unit area (1 $m^2$) in the partitioning member 1 can be impregnated in the element forming unit 10. It goes without saying that saturation concentration of the lithium chloride can be set higher than the value explained above and can be dissolved up to 84.8 parts by mass with respect to 100 parts by mass of water (the concentration of the lithium chloride at this point is about 46 percent by mass). Application amounts of the adhesives 7A and 7B can be set to values larger than the values explained above. Therefore, a larger amount of the moisture-absorbing agent (lithium chloride) can be impregnated in the total heat exchange element 20.

However, in the bonding step JS, because the space holding members 5 and the element forming unit 10 are affected by a temperature change, a humidity change, and the like under a manufacturing environment, deformation or softening thereof tends to occur. Therefore, it is desirable to select the application amount of the adhesive 7A such that the deformation or softening and fluctuation in the deformation or softening among the space holding members or the element forming units are suppressed. In the laminating step LS, the application amount of the adhesive 7B is selected according to the content of the moisture-absorbing agent in the adhesive 7A and the concentration of the moisture-absorbing agent in the adhesive 7B applied to the space holding members 5 in the bonding step such that the impregnation amount of the moisture-absorbing agent in the total heat exchange element 20 reaches a desired amount. The concentration of the moisture-absorbing agent in the adhesive 7A and the concentration of the moisture-absorbing agent in the adhesive 7B can be selected separately from each other.

In the manufacturing method according to this embodiment, in manufacturing the total heat exchange element 20, it is unnecessary to impregnate a large amount of water-soluble moisture-absorbing agent in the base paper 5*a* of the space holding member 5 in advance as explained above. Therefore, softening and deformation (elongation) of the base paper 5*a* involved in moisture absorption can be easily suppressed. Occurrence of deficiencies in processing such as a shaping failure and breakage in shaping the base paper 5*a* into a corrugated shape can also be easily suppressed. In other words, the space holding members 5 can be obtained under satisfactory workability. The same hold true for the partitioning members 1. It is also easy to prevent, from the time when a plurality of element forming units are obtained until the element forming units are assembled in the total heat exchange element 20, the element forming units from being conspicuously deformed by moisture absorption. Therefore, it is easy to make workability in assembling the total heat exchange element 20 satisfactory. The total heat exchange element 20 can be obtained under the same man-hour as in manufacturing the total heat exchange element 20 using an adhesive in which a water-soluble moisture-absorbing agent is not dissolved.

Therefore, according to the manufacturing method, it is easy to manufacture, under high productivity, the total heat exchange element 20 made of paper impregnated with a desire amount of moisture-absorbing agent. Base paper not impregnated with the moisture-absorbing agent can be used as the base papers as the materials of the partitioning members 1 and the space holding members 5. Therefore, material cost of the base material can also be reduced.

Second Embodiment

Element forming units forming a total heat exchange element can also be manufactured by continuous processing other than being manufactured by batch processing. The element forming units can be obtained by performing a step of sticking long base paper as a material of space holding members and long base paper as a material of partitioning members together to manufacture long element forming unit materials and a step of cutting the long element forming unit materials into appropriate size. In this case, the long base paper as the material of the space holding members and the long base paper as the material of the partitioning members are shaped into rolls in advance, respectively.

Figure 4:
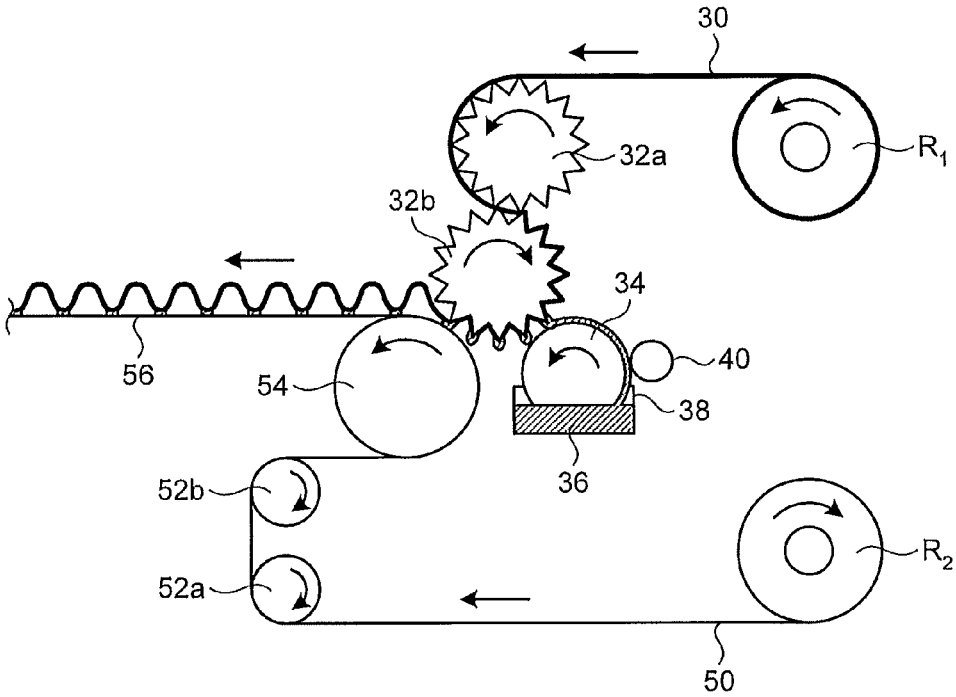
FIG. 4 is a schematic diagram of an example of equipment used in manufacturing element forming units of the total heat exchange element according to continuous processing.

FIG. 4 is a schematic diagram of an example of equipment used in manufacturing element forming units according to continuous processing. The step of manufacturing the long element forming unit materials is performed by this equipment. In the equipment shown in the figure, long base paper 30 as a material of space holding members is shaped into a roll $R_1$ in advance and long base paper 50 as a material of partitioning members is shaped into a roll $R_2$ in advance. The base paper 30 drawn out from the roll $R_1$ is shaped into a corrugated shape by a pair of shaping rolls 32*a* and 32*b*. An adhesive 36 is applied to the base paper 30 after the shaping by a roll 34 while the base paper 30 is guided in a predetermined direction by the shaping roll 32*b*.

The adhesive 36 is a water-solvent adhesive in which a water-soluble moisture-absorbing agent is dissolved. The adhesive 36 is pooled in an adhesive tank 38. The roll 34 is partially immersed in the adhesive tank 38. When the roll 34 rotates in a predetermined direction, the adhesive 36 adheres to the circumferential surface of the coating roll 34 and is further applied to one side of the base paper 30 shaped in the corrugated shape. A squeezing roll 40 is arranged near the roll 34 to prevent the adhesive 36 from excessively adhering to the circumferential surface of the roll 34. An application amount of the adhesive 36 can be arbitrarily adjusted in a range equal to or smaller than a limit value decided by the viscosity of the adhesive 36. If the space is increased, the application amount of the adhesive 36 increases and, if the space is reduced, the application amount decreases. For example, when the viscosity of the adhesive 36 is 100 to 500 mPa·s and the specific gravity of the adhesive 36 is about 1, if the space between the roll 34 and the squeezing roll 40 is set to be equal to or larger than 0.4 millimeters, the application amount of the adhesive 36 can be easily increased to be equal to or larger than 50 $g/m^2$.

On the other hand, the base paper 50 drawn out from the roll R2 is guided to a press roll 54 side by two guide rolls 52*a* and 52*b*. The press roll 54 is opposed to the shaping roll 32*b* at a predetermined space. In a process in which the base paper 50 is guided in a predetermined direction by the press roll 54, the base paper 50 and the base paper 30 shaped in the corrugated shape are stuck together by the adhesive 36. As a result, long element forming unit materials 56 as a material of the element forming units are continuously manufactured. In FIG. 4, rotating directions of the rolls and conveying directions of the base papers 30 and 50 are indicated by solid line arrows.

Thereafter, the element forming units are continuously manufactured through a step of cutting the element forming unit material 56 into predetermined size with a cutting machine not shown in the figure. A step until the element forming units are obtained in this way is a bonding step. In the bonding step, the base paper 30 and the base paper 50 after being shaped into the corrugated shape are cut after being bonded by the adhesive 36. In the bonding step according to the first embodiment, the space holding members and the partitioning members cut in advance are bonded. However, regardless of whether a bonding target is base paper, the bonding step in this embodiment and the bonding step in the first embodiment are the same in that the adhesive in which the moisture-absorbing agent is dissolved is used.

In a laminating step after the element forming unit 10 (see FIG. 3) is obtained in the bonding step shown in FIG. 4, as in the laminating step in the first embodiment, after a water-solvent adhesive in which a water-soluble moisture-absorbing agent is dissolved is applied to the respective element forming units manufactured in the bonding step, the element forming units are laminated to obtain a total heat exchange element. The application of the adhesive to the respective element forming units can be performed by using, for example, equipment schematically shown in FIG. 5.

Figure 5:
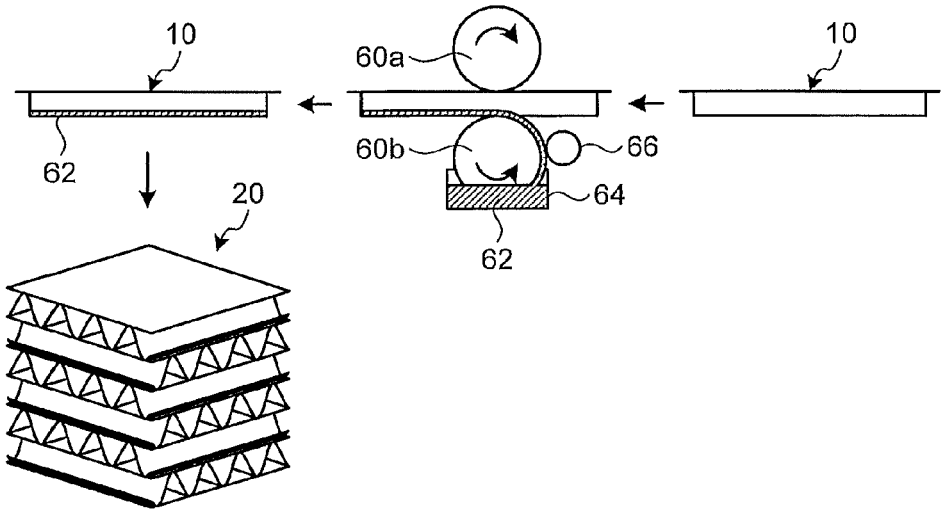
FIG. 5 is a schematic diagram of an example of equipment used in applying an adhesive to the element forming units of the total heat exchange element.

The equipment shown in FIG. 5 includes a pair of rolls 60*a* and 60*b*, an adhesive tank 64 in which an adhesive 62 is pooled, a squeezing roll 66 arranged near the roll 60*b*, and a conveying device not shown in the figure. The element forming unit 10 is conveyed to the pair of rolls 60*a* and 60*b* by the conveying device with the space holding member faced down. The adhesive 62 is applied to the element forming unit 10 in the pair of rolls 60*a* and 60*b*. A plurality of the element forming units 10 are conveyed at predetermined intervals.

The roll 60*a* on the upper side of the pair of rolls 60*a* and 60*b* functions as a conveying roll that conveys the element forming unit 10 in a predetermined direction. The roll 60*b* on the lower side functions as a roll that is partially immersed in the adhesive tank 64 and applies the adhesive 62 to the element forming unit 10. When the roll 60*b* rotates in a predetermined direction, the adhesive 62 adheres to the circumferential surface of the roll 60*b* and is further applied to the space holding member in the element forming unit 10. The squeezing roll 66 is arranged near the roll 60*b* and removes the adhesive 62 excessively adhering to the circumferential surface of the roll 60*b*. An application amount of the adhesive 62 to the element forming unit 10 can be adjusted by adjusting a space between the roll 60*b* and the squeezing roll 66.

The element forming units 10 applied with the adhesive 62 are laminated with a direction thereof selected such that corrugation of the space holding member in one element forming unit 10 and corrugation of the space holding member in the element forming unit 10 above or below the one element forming unit 10 cross each other at 90 degrees or an angle close to 90 degrees in plan view. The element forming units 10 adjacent to each other in the laminating direction are bonded to each other by the adhesive 62. As a result, the total heat exchange element 20 is obtained.

When the total heat exchange element 20 is manufactured in this way, because of a reason same as the reason explained in the first embodiment, it is easy to manufacture, under high productivity, the total heat exchange element 20 made of paper impregnated with a desired amount of moisture-absorbing agent. Base paper not impregnated with the moisture-absorbing agent can be used as base papers as materials of the partitioning members and the space holding members. Therefore, material cost of the base papers can be reduced.

Third Embodiment

In this embodiment, a water-solvent adhesive in which a water-soluble moisture-absorbing agent is dissolved is used only in a bonding step. An adhesive in which the water-soluble moisture-absorbing agent is not dissolved is used in a laminating step. Element forming units can be manufactured by the batch processing as in the manufacturing method explained in the first embodiment or can be manufactured by the continuous processing as in the manufacturing method explained in the second embodiment.

When the element forming units are manufactured by the batch processing, a total heat exchange element can be manufactured in the same manner as in the manufacturing method explained in the first embodiment except that the adhesive in which the water-soluble moisture-absorbing agent is not dissolved, for example, a polyvinyl acetate emulsion adhesive is used as the adhesive 7B shown in FIG. 3. On the other hand, when the element forming units are manufactured by the continuous processing, the total heat exchange element can be manufactured in the same manner as in the manufacturing method explained in the second embodiment except that the adhesive in which the water-soluble moisture-absorbing agent is not dissolved, for example, a polyvinyl acetate emulsion adhesive is used as the adhesive 62 shown in FIG. 4.

For example, when there is a large difference in paper thickness and basis weight (weight per unit area) between, for example, base paper of partitioning members and base paper of space holding members, if an impregnation amount of a water-soluble moisture-absorbing agent in the element forming units is reduced, large deformation may occur in the element forming units. In terms of suppressing this deformation, it is desirable to manufacture the element forming units using the water-solvent adhesive in which the water-soluble moisture-absorbing agent in the bonding step. The concentration of the water-soluble moisture-absorbing agent in the water-solvent adhesive is appropriately selected according to an application amount of the adhesive, the thickness and the basis weight in the base papers of the partitioning members and the space holding members, an expansion amount of the base papers during moisture absorption, a contraction amount of the base papers during drying, humidity exchange efficiency required of the total heat exchange element, and the like.

When the total heat exchange element is manufactured in this way, it is easy to manufacture, under high productivity, a total heat exchange element made of paper in which a predetermined amount of moisture-absorbing agent is impregnated. Base paper not impregnated with the moisture-absorbing agent can be used as base papers as materials of the partitioning members and the space holding members. Therefore, material cost of the base papers can be reduced. Further, management of an impregnation amount of the moisture-absorbing agent that determines performance of the total heat exchange element (management of the concentration of the moisture-absorbing agent in the adhesive and management of an application amount of the adhesive) only has to be performed in the bonding step. Therefore, it is easy to reduce fluctuation in the impregnation amount of the moisture-absorbing agent among total heat exchanging elements produced in mass to be smaller than that in the manufacturing method explained in the first embodiment or the second embodiment.

Fourth Embodiment

In this embodiment, a water-solvent adhesive in which a water-soluble moisture-absorbing agent is dissolved is used only in a laminating step. An adhesive in which the water-soluble moisture-absorbing agent is not dissolved is used in a bonding step. Element forming units can be manufactured by the batch processing as in the manufacturing method explained in the first embodiment or can be manufactured by the continuous processing as in the manufacturing method explained in the second embodiment.

When the element forming units are manufactured by the batch processing, a total heat exchange element can be manufactured in the same manner as in the manufacturing method explained in the first embodiment except that the adhesive in which the water-soluble moisture-absorbing agent is not dissolved, for example, a polyvinyl acetate emulsion adhesive is used as the adhesive 7A shown in FIG. 3. On the other hand, when the element forming units are manufactured by the continuous processing, the total heat exchange element can be manufactured in the same manner as in the manufacturing method explained in the second embodiment except that the adhesive in which the water-soluble moisture-absorbing agent is not dissolved, for example, a polyvinyl acetate emulsion adhesive is used as the adhesive 36 shown in FIG. 4. A desired amount of moisture-absorbing agent can be impregnated in the total heat exchange element by appropriately selecting the concentration of the water-soluble moisture-absorbing agent in the adhesive used in the laminating step and an application amount of the adhesive.

When the total heat exchange element is manufactured in this way, the water-soluble moisture-absorbing agent is not impregnated in partitioning members and base paper thereof and space holding members and base paper thereof. Therefore, it is easy to suppress deformation and softening involved in moisture absorption and fluctuation in the deformation and the softening in all of the partitioning members, the space holding members, and the element forming units. As a result, it is easy to manufacture, under high productivity, a total heat exchange element made of paper impregnated with a desired amount of moisture-absorbing agent. Base paper not impregnated with the moisture-absorbing agent can be used as base papers as materials of the partitioning members and the space holding members. Therefore, material cost of the base papers can be reduced.

Further, management of an impregnation amount of the moisture-absorbing agent that determines performance of the total heat exchange element (management of the concentration of the moisture-absorbing agent in the adhesive and management of an application amount of the adhesive) only has to be performed in the laminating step. Therefore, it is easy to reduce fluctuation in the impregnation amount of the moisture-absorbing agent among total heat exchanging elements produced in mass to be smaller than that in the manufacturing method explained in the first embodiment or the second embodiment.

Fifth Embodiment

In this embodiment, a moisture-absorbing agent is added to base paper of partitioning members and base paper of space holding members in advance. Otherwise, the bonding step and the laminating step are performed in the same manner as in the manufacturing method explained in any one of the first to fourth embodiments to obtain a total heat exchange element. The moisture-absorbing agent added to the base papers in advance can be a water-soluble moisture-absorbing agent or can be a non-water-soluble moisture-absorbing agent such as silica gel, strong acid ion exchange resin, or strong basic ion exchange resin.

However, the performance of the total heat exchange element is most stable when the moisture-absorbing agent is uniformly distributed in the total heat exchange element. Therefore, in terms of uniformalizing the concentration distribution of the moisture-absorbing agent in the total heat exchange element as much as possible, the moisture-absorbing agent added in advance to the base paper and the water-soluble moisture-absorbing agent dissolved in the adhesive used in the bonding step or the laminating step are preferably moisture-absorbing agent having the same composition. If the moisture-absorbing agent added in advance to the base paper and the water-soluble moisture-absorbing agent dissolved in the adhesive have the same composition, diffusion of the moisture-absorbing agent occurs in the total heat exchange element via moisture. The concentration distribution of the moisture-absorbing agent becomes uniform in a relatively short time or approaches a uniform state.

An amount of the moisture-absorbing agent in the total heat exchange element is a sum of an amount of the moisture-absorbing agent added to the base paper in advance and the content of the water-soluble moisture-absorbing agent in the adhesive used in the bonding step or the laminating step. In terms of increasing the amount of the moisture-absorbing agent in the total heat exchange element as much as possible, it is desirable to add a large amount of moisture-absorbing agent to the base paper in advance. However, if softening or deformation of the base paper involved in moisture absorption or a deficiency in processing such as a shaping failure or breakage in manufacturing space holding members occurs, productivity of the total heat exchange element falls. Therefore, it is desirable to select an amount of the moisture-absorbing agent added to the base paper in advance in a range in which productivity of the total heat exchange element does not fall.

Even when the total heat exchange element is manufactured in this way, it is easy to manufacture, under high productivity, a total heat exchange element made of paper impregnated with a desired amount of moisture-absorbing agent. Compared with the manufacturing of the total heat exchange element according to the manufacturing methods explained in the first to fourth embodiments, it is easy to obtain a total heat exchange element with a large amount of moisture-absorbing agent.

The method of manufacturing a total heat exchange element according to the present invention is explained above with reference to the embodiments. However, as explained above, the present invention is not limited to the embodiments. For example, the water-soluble agent dissolved in the water-solvent adhesive used in the bonding step or the laminating step is not limited to the moisture-absorbing agent. The water-soluble agent can be a water-soluble flame retardant like guanidine salt such as guanidine sulfamate or other water-soluble agents. A type of the water-soluble agent dissolved in the adhesive is not limited to one type. Two or more types of agents that play the same function or different functions can also be dissolved. As in the manufacturing method explained in the fifth embodiment, the same holds true when a desired agent is added to the base paper of the partitioning members and the base paper of the space holding members in advance.

The application of the adhesive in which the water-soluble agent is dissolved to the space holding members or the element forming units can be performed by other methods such as spray coating other than being performed by using the roller as explained in the first and second embodiments. Shapes of the space holding members, the element forming units, the heat exchange units, and the total heat exchange element can also be appropriately selected according to an application of a total heat exchange element to be manufactured, performance required of the total heat exchange element, and the like. A plurality of element forming units forming the total heat exchange element do not have to be bonded to one another as long as the element forming units adjacent to each other in the laminating direction adhere to each other. The number of element forming units in the total heat exchange element can be appropriately selected. Concerning the method of manufacturing a total heat exchange element, various modifications, modifications, combinations, and the like are possible other than the embodiments.

The invention claimed is:

1. A method of manufacturing a total heat exchange element that includes a sheet-like partitioning member and space holding members on both sides of the partitioning member to form air paths for performing a heat exchange via the partitioning member between an air flow flowing through an air path formed on one side of the partitioning member and an air flow flowing through an air path formed on an other side of the partitioning member, the method comprising:

bonding the partitioning member and the space holding members by a water-solvent adhesive in which a water-soluble moisture-absorbing agent is dissolved, and wherein the partitioning member is made of paper such that the water-soluble moisture-absorbing agent diffuses into the partitioning member by the bonding.

2. The method according to claim 1, wherein at least one of the partitioning member and the space holding members contains a water-soluble moisture-absorbing agent that is impregnated in advance, and the water-soluble moisture-absorbing agent dissolved in the adhesive has a composition same as that of the water-soluble moisture-absorbing agent impregnated in the partitioning member or the space holding members.

3. A method of manufacturing a total heat exchange element that includes plural element forming units laminated together, each element forming unit including a sheet-like partitioning member and a space holding member bonded to the partitioning member to form air paths for performing a heat exchange via the partitioning member between air flows flowing through the air paths adjacent to each other, the method comprising:

obtaining an element forming unit in which the partitioning member and the space holding members are bonded by an adhesive; and bonding element forming units with the adhesive to obtain a total heat exchange element in which plural element forming units are laminated, wherein at least one of the obtaining and the bonding includes employing a water-solvent adhesive in which a water-soluble moisture-absorbing agent is dissolved, and wherein the partitioning member is made of paper such that the water-soluble moisture-absorbing agent diffuses into the partitioning member by the at least one of the obtaining and the bonding.

4. The method according to claim 3, wherein at least one of the partitioning member and the space holding members contains a water-soluble moisture-absorbing agent that is impregnated in advance, and the water-soluble moisture-absorbing agent dissolved in the adhesive has a composition same as that of the water-soluble moisture-absorbing agent impregnated in the at least one of the partitioning member and the space holding members.

5. The method according to claim 3, wherein the obtaining includes bonding the partitioning member and the space holding members to each other with the adhesive to obtain an element forming unit material, and cutting the element forming unit material to obtain the element forming unit.

6. A method of manufacturing a total heat exchange element that includes a sheet-like partitioning member and space holding members on both sides of the partitioning member to form air paths for performing a heat exchange via the partitioning member between an air flow flowing through an air path formed on one side of the partitioning member and an air flow flowing through an air path formed on other side of the partitioning member, wherein each of the partitioning member and the space holding members is made of paper, and the method comprising:

bonding the partitioning member and the space holding members by a water-solvent adhesive in which a water-soluble flame retardant is dissolved, and wherein the partitioning member is made of paper such that the water-soluble flame retardant diffuses into the partitioning member by the bonding.

7. The method according to claim 6, wherein at least one of the partitioning member and the space holding members contains a water-soluble flame retardant that is impregnated in advance, and the water-soluble flame retardant dissolved in the adhesive has a composition same as that of the water-soluble flame retardant impregnated in the at least one of the partitioning member and the space holding members.

8. A method of manufacturing a total heat exchange element that includes plural element forming units laminated together, each element forming unit including a sheet-like partitioning member and a space holding member bonded to the partitioning member to form air paths for performing a heat exchange via the partitioning member between air flows flowing through the air paths adjacent to each other, the method comprising:

obtaining an element forming unit in which the partitioning member and the space holding members are bonded by an adhesive; and bonding element forming units with the adhesive to obtain a total heat exchange element in which plural element forming units are laminated, wherein at least one of the obtaining and the bonding includes employing a water-solvent adhesive in which a water-soluble flame retardant is dissolved, and the partitioning member is made of paper such that the water-soluble flame retardant diffuses into the partitioning member by the at least one of the obtaining and the bonding.

9. The method according to claim 8, wherein at least one of the partitioning member and the space holding members contains a water-soluble flame retardant that is impregnated in advance, and the water-soluble flame retardant dissolved in the adhesive has a composition same as that of the water-soluble flame retardant impregnated in the at least one of the partitioning member and the space holding members.

10. The method according to claim 8, wherein the obtaining includes bonding the partitioning member and the space holding members to each other with the adhesive to obtain an element forming unit material, and cutting the element forming unit material to obtain the element forming unit.

11. A method of manufacturing a total heat exchange element that includes a sheet-like partitioning member and space holding members on both sides of the partitioning member to form air paths for performing a heat exchange via the partitioning member between an air flow flowing through an air path formed on one side of the partitioning member and an air flow flowing through an air path formed on other side of the partitioning member, bonding the partitioning member and the space holding members by a water-solvent adhesive in which a water-soluble moisture-absorbing agent and a water-soluble flame retardant are dissolved, and wherein the partitioning member is made of paper such that the water-soluble flame retardant diffuses into the partitioning member by the bonding.

12. The method according to claim 11, wherein at least one of the partitioning member and the space holding members contains a water-soluble moisture-absorbing agent and a water-soluble flame retardant that are impregnated in advance, and the water-soluble moisture-absorbing agent and the water-soluble flame retardant dissolved in the adhesive have compositions same as those of the water-soluble moisture-absorbing agent and the water-soluble flame retardant impregnated in the at least one of the partitioning member and the space holding members, respectively.

13. A method of manufacturing a total heat exchange element that includes plural element forming units laminated together, each element forming unit including a sheet-like partitioning member and a space holding member bonded to the partitioning member to form air paths for performing a heat exchange via the partitioning member between air flows flowing through the air paths adjacent to each other, the method comprising:

obtaining an element forming unit in which the partitioning member and the space holding members are bonded by an adhesive; and bonding element forming units with the adhesive to obtain a total heat exchange element in which plural element forming units are laminated, wherein at least one of the obtaining and the bonding includes employing a water-solvent adhesive in which a water-soluble moisture-absorbing agent and a water-soluble flame retardant are dissolved, and the partitioning member is made of paper such that the water-soluble moisture-absorbing agent diffuses into the partitioning member by the at least one of the obtaining and the bonding.

14. The method according to claim 13, wherein at least one of the partitioning member and the space holding members contains a water-soluble moisture-absorbing agent and a water-soluble flame retardant that are impregnated in advance, and the water-soluble moisture-absorbing agent and the water-soluble flame retardant dissolved in the adhesive have compositions same as those of the water-soluble moisture-absorbing agent and the water-soluble flame retardant impregnated in the at least one of the partitioning member and the space holding members, respectively.

15. The method according to claim 13, wherein the obtaining includes bonding the partitioning member and the space holding members to each other with the adhesive to obtain an element forming unit material, and cutting the element forming unit material to obtain the element forming unit.

* * * * *